US008048268B2

(12) United States Patent
Jiang et al.

(10) Patent No.: US 8,048,268 B2
(45) Date of Patent: Nov. 1, 2011

(54) METHOD OF CONTROLLING ORGANIC CONTAMINANTS IN PULP AND PAPER MAKING PROCESSES

(75) Inventors: Chengliang Jiang, Duluth, GA (US); Xiang H. Wang, Alpharetta, GA (US); Jianhua Ma, Alpharetta, GA (US); James G. Tausche, Atlanta, GA (US)

(73) Assignee: Enzymatic Deinking Technologies, LLC, Norcross, GA (US)

( * ) Notice: Subject to any disclaimer, the term of this patent is extended or adjusted under 35 U.S.C. 154(b) by 72 days.

(21) Appl. No.: 12/606,671

(22) Filed: Oct. 27, 2009

(65) Prior Publication Data

US 2011/0094695 A1 Apr. 28, 2011

(51) Int. Cl.
*D21H 11/00* (2006.01)

(52) U.S. Cl. ..... 162/166

(58) Field of Classification Search ..... 162/199
See application file for complete search history.

(56) References Cited

U.S. PATENT DOCUMENTS

| | | | | |
|---|---|---|---|---|
| 3,873,417 | A * | 3/1975 | Otrhalek et al. | 162/168.7 |
| 3,992,249 | A | 11/1976 | Farley | |
| 4,871,424 | A | 10/1989 | Dreisbach et al. | |
| 4,886,575 | A | 12/1989 | Moreland | |
| 4,956,051 | A | 9/1990 | Moreland | |
| 5,135,613 | A * | 8/1992 | Waldmann | 162/199 |
| 5,286,347 | A * | 2/1994 | Richardson | 162/199 |
| 5,433,824 | A * | 7/1995 | Richardson | 162/8 |
| 5,627,232 | A | 5/1997 | Glancy et al. | |
| 5,914,373 | A | 6/1999 | Glancy et al. | |
| 7,067,244 | B2 * | 6/2006 | Jiang et al. | 435/4 |
| 7,166,192 | B2 | 1/2007 | van de Steeg et al. | |
| 2004/0102585 | A1 | 5/2004 | Steinmetz et al. | |

FOREIGN PATENT DOCUMENTS

| | | |
|---|---|---|
| EP | 0 568 229 | 11/1993 |
| WO | WO 2004/113611 | 12/2004 |

* cited by examiner

*Primary Examiner* — Mark Halpern
(74) *Attorney, Agent, or Firm* — Pabst Patent Group LLP

(57) ABSTRACT

Method for controlling the deposition of organic contaminants from the pulp and papermaking systems using water soluble aminoplast ether copolymers is described herein. The aminoplast ether copolymer can be used alone or in combination with one or more additives. The pulps to be treated include mechanical, chemical, semi-chemical pulps; sulfide pulp; recycled old newspapers; mixed office wastes; corrugated boxes; and their combinations. The use of water soluble aminoplast ether copolymers to control or prevent pitch and stickies deposition improves down stream performance of papermaking equipment increasing mill efficiency and improving paper quality.

45 Claims, No Drawings

METHOD OF CONTROLLING ORGANIC CONTAMINANTS IN PULP AND PAPER MAKING PROCESSES

FIELD OF THE INVENTION

The present invention is generally in the field of methods for controlling pitch and stickies deposition in pulp and paper making processes.

BACKGROUND OF THE INVENTION

Organic contaminants in the pulp and papermaking processes cause serious problems for both paper quality and pulp and paper making efficiency. These contaminants generally include naturally occurring wood pitch or wood resin and synthetic materials such as stickies found in fibers from recovered fiber sources or from mill processes. Wood pitch includes triglycerides, fatty acids, resin acids, steryl esters and sterols. Wood resins, as well as other extractives such as lignans, pectins, and phenols, are the major components of pitch deposits. During the mechanical pulping process and subsequent treatments, the wood pitch is released from the surfaces of fibers and accumulates in the whitewater in the form of colloid particles. The pitch can also contain inorganic compounds such as calcium carbonate, talc, clay, titanium oxide and alum hydroxide or reaction products of resin or fatty acids with metal ions.

Stickies generally refer to the undesirable organic contaminants present in the recycled fibers. Stickies often contain the same natural materials found in pitch deposits as well as synthetic materials including adhesives such as styrene-butadiene copolymer, polyacrylate and polyethylene, hot melts such as ethylene vinyl acetate and polyvinyl acetate, waxes, mineral oils, styrene-acrylate, and wet-strength chemicals such as melamine-formaldehyde. Since stickies are composed mainly of synthetic materials, they are more inclined to deposit on equipment surfaces containing plastic materials such as paper machine wires, wet felts, dryer felts and dryer cans.

Pitch and stickies have a detrimental impact on the pulp and papermaking process, reducing paper machine efficiency and paper quality. Wood pitch and stickies have very low surface energy and tend to deposit on pipe surfaces, chest walls, wires, uhle boxes, doctor blades, fabrics, wet felts, dryer felts, dryer cans and calendar stacks. Deposition of pitch and stickies results in operational difficulties and the malfunctioning of mill equipment. When recycled paper is used, the stickies in the waste paper can accumulate on mill equipment resulting in similar problems. When mechanical pulp is co-present with recycled paper, the combination of wood pitch and stickies generally increases the amount of deposition. Accumulated pitch or stickies particles contaminate the paper sheet when they break free from metal, ceramic, and plastic surfaces of mill equipment causing off quality paper and paper machine breaks. The increased use of recycled fiber can significantly aggravate the problem.

Conventional techniques for pitch and stickies control include dispersion, detackification, adsorption and cationic fixation. Dispersion chemicals include surfactants, polymers, and inorganic dispersants such as polyphosphates. Adsorption materials include talc which interacts with pitch or stickies surfaces to render them less tacky. Talc can be effective for synthetic stickies materials, particularly stickies particles, by adsorbing the particles which aids in dispersing the pitch in the stock and whitewater system and reduces the deposition of pitch on the machine wires and felts.

Various kinds of surfactants and water soluble polymers have been investigated to control the deposition of organic contaminants contained in the fibers of the pulp and papermaking processes.

U.S. Pat. No. 3,992,249 to Farley discloses a chemistry for preventing the deposition of adhesive pitch particles on pulp-making equipment using anionic vinyl polymers containing at least 25-85% of hydropobic-olephilic linkages selected from styrene, isobutylene, methyl styrene, ally stearate, octadecyl acrylate, octadecene, dedecene, n-octadecylarylamide, vinyl stearate and vinyl dodecyl ether and at least 15-75% hydrophilic acid linkages selected from acrylic acid, methacrylic acid, and maleic acid, itaconic acid, acrylamidoacetic acid, maleamic acid and styrenesulfonic acid. The copolymers are anionic in nature.

U.S. Pat. Nos. 4,871,424, 4,886,575, and 4,956,051 describe the use of water soluble polyvinyl alcohols having 50% to 100% hydrolysis to inhibit pitch deposition from pulp in paper-making systems. The polymer is a water-soluble copolymer having recurring entities of nonionic hydrophilic units of vinyl alcohol and hydrophobic units of vinyl acetate. The molecular weight of the polyvinyl alcohol ranges from 90,000 to 150,000. It is preferred that the degree of hydrolysis is in the range of 85% to 90% and that the polymer has a molecular weight around 125,000. Polyvinyl alcohol is often used as an industry standard for comparing different organic contaminant control chemicals.

EP 0568229A1 describes the use of hydrophobically modified hydroxyethyl cellulose (HMHEC) for preventing the deposition of pitch and stickies.

WO2004/113611 and U.S. Pat. No. 7,166,192 to Steeg describe methods for controlling pitch and stickies by adding HMHEC and cationic polymers to a cellulosic fiber slurry.

The prior art describes the use of different surfactants and polymers in the prevention of pitch and stickies. Each of those chemistries has their own limitations, however, and is only effective for a narrow range of organic contaminants.

There exists a need for improved materials and methods for the prevention and/or control of pitch and stickies deposition.

Therefore, it is an object of the invention to provide materials and methods for the control and/or prevention of pitch and stickies deposition.

It is a further object of the invention to provide materials and methods for preventing and/or controlling pitch and stickies deposition wherein the materials and methods are effective for a variety of pitch and stickies components.

SUMMARY OF THE INVENTION

Methods for controlling the deposition of pitch and stickies in pulp and papermaking processes are described herein. In one embodiment, a water soluble aminoplast ether copolymer is administered to control pitch and stickies deposition. The water soluble aminoplast ether copolymers possess a unique chemical structure, wherein the hydrophobes are located not only at both ends of the polymer, but also within the polymer backbone. The hydrophobes of the polymers interact with hydrophobic organic contaminants surfaces rendering the contaminants less hydrophobic and less tacky. The polymers described herein prevent the deposition of organic contaminants on the surfaces of equipment, pipe walls, chest walls and a buildup in the whitewater system.

The polymers described herein can be added continuously or in batch prior to or near to the site where deposition problems occur. The polymers can be used in different pulp and papermaking processes, including wastepaper recycling, Kraft pulping, sulfite pulping, tissue making, paper and linerboard production.

The use of water soluble aminoplast ether copolymers to control or prevent pitch and stickies deposition improves down stream performance of papermaking equipment increasing mill efficiency and improving paper quality.

DETAILED DESCRIPTION OF THE INVENTION

I. Definitions

"Pitch deposits" as used herein refers to a composition composed of low molecular weight olephilic materials (primarily triglycerides, resin acids, fatty acids, waxes, resin esters, fatty alcohols, sterols, and terpenes), as well as pectins, lignans, and phenolic compounds, which are released from wood fibers during chemical and mechanical pulping processes. Some of these resinous substances precipitate as aluminum, calcium and magnesium salts, causing problems with the wet end components of paper machines and affecting paper quality.

"Mechanical pulp" refers to pulp produced by reducing pulpwood logs and chips into fiber component by the use of mechanical energy, comprising stone ground wood pulp, pressurized ground wood pulp and thermomechanical pulp.

"Stone ground wood pulp" or "SOW" as used herein, refers to pulp which is produced by grinding wood into relatively short fibers with stone grinding. This pulp is used mainly in newsprint and wood-containing papers, such as lightweight coated (LWC) and super-calendered (SC) papers.

"Pressurized groundwood pulp" or "PGW" refers to pulp produced by a stone grinder where the whole grinder casing is pressurized and increased shower water temperature is used.

"Thermomechanical pulp" or "TMP" as used herein, refers to pulp that is produced in a thermo-mechanical process where wood chips or sawdust are softened by steam before entering a pressurized refiner. TMP generally has the same end-uses as stone groundwood pulp.

"Semi-chemical pulp" as used herein, refers to pulp produced by a combination of some chemicals (less than those used in Kraft pulping) and unpressurized mechanical processes. A variety of this pulp with pretreated chips at a temperature over 100° C. followed by refining at atmospheric pressure is called "semichemical mechanical pulp" or "SCMP". This pulp has properties suitable for tissue manufacture.

"Chemo-Thermomechanical Pulp" or "CTMP" as used herein, refers to mechanical pulp produced by treating wood chips with chemicals (usually sodium sulfite) and steam before mechanical defiberization.

"Chemical pulp", as used herein, refers to pulp produced by the treatment of wood chips or sawdust with chemicals to liberate the cellulose fibers by removing the binding agents such as lignin resins and gums. Sulphite and Sulphate or Kraft are two types of chemical pulping. Kraft is the predominant pulping process in chemical pulp production.

"Recycled pulp" or "recycled fibers" refers to fiber component of a paper or paperboard furnish that is derived from recycled paper and paperboard or wastepaper.

II. Methods for Controlling or Preventing Pitch and Stickies Deposition

Methods for preventing and/or controlling pitch and stickies deposition are described herein. In one embodiment, a water-soluble aminoplast ether copolymer is administered to control and/or prevent pitch and stickies deposition.

The water soluble aminoplast ether copolymers suitable for the methods described herein contain aminoplast segments interlinked through ether bond segments as represented by the following structure:

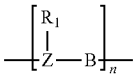

where Z represents aminoplast central units that are condensation products of an aldehyde (e.g., formaldehyde) with one or more amine-containing monomers. Suitable amine-containing monomers include, but are not limited to, Glycoluril, Ureas, melamine, and benzoguanamine. The structures of these amine-containing monomers are shown below,

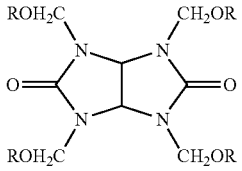

Glycoluril

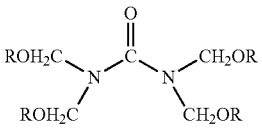

Urea-formaldehyde

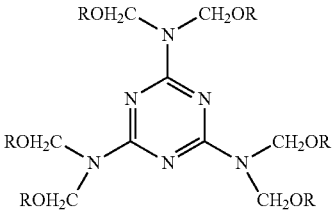

Melamine-formaldehyde

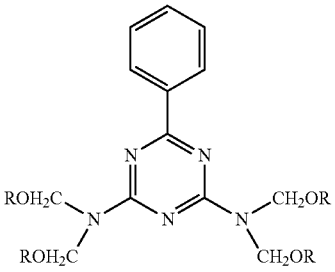

Benzoguanamine

The aminoplast central units can be unsubstituted or substituted by a reactive OR group where R is an alkyl, alkylene, alkyl ether or alkyl ester group.

"Alkyl", as used herein, refers to the radical of saturated or unsaturated aliphatic groups, including straight-chain alkyl, alkenyl, or alkynyl groups, branched-chain alkyl, alkenyl, or alkynyl groups, cycloalkyl, cycloalkenyl, or cycloalkynyl (alicyclic) groups, alkyl substituted cycloalkyl, cycloalkenyl, or cycloalkynyl groups, and cycloalkyl substituted alkyl, alkenyl, or alkynyl groups. Unless otherwise indicated, a straight chain or branched chain alkyl has 30 or fewer carbon atoms in its backbone (e.g., C1-C30 for straight chain, C3-C30 for branched chain), preferably 20 or fewer, preferably 10 or fewer, more preferably 6 or fewer, most preferably 5 or fewer.

In a preferred embodiment, R is a lower alkyl group. "Lower alkyl", as used herein, refers to a group having 1-4 carbons. In one embodiment, the lower alkyl group is a methyl or ethyl group.

B is a radical of a hydrophobic or a water-insoluble oligomer or polymer. "Hydrophobic", as used herein, refers to oligomers or polymers which lack an affinity for water. "Water-insoluble", as used herein, means an oligomer or polymer that is not soluble in water. Suitable hydrophobic oligomers and polymers include, but are not limited to, poly-n-butyl acrylate, poly-n-butyl methacrylate, polyethyl acrylate, polytetrahydrofuran, polyethyl methacrylate, polymethyl acrylate, polymethyl methacrylate, polymethyl acryalte, polymethyl methacrylate, aliphatic polycarbonates, aromatic polycarbonates, and combinations thereof. B typically contains one or more reactive functional groups which allow the oligomer or polymer to react with the OR group on the aminoplast unit.

R1 is a radical of a hydrophilic organic compound containing at least one functional group which is able to react with the OR function of the aminoplast unit to form an ether bond. "Hydrophilic", as used herein, refers to a radical or moiety that has an affinity for water, "Water soluble", as used herein, means the compound, oligomer, or polymer is soluble in water. Suitable hydrophilic moieties include, but are not limited to, methylcellulose, polyacrylic acid, polymethacrylic acid, ethylene/acrylic acid/sodium acrylate copolymer, polyalkylglycol, polyvinyl alcohol, and polyvinylpyrrolidone preferably having at least one hydroxyl function group.

The mole ratio of R1 to B is preferably greater than 1, most preferably in the range of 1.0 to 4.0. The index number "n" is from 1 to 2000, preferably from 1 to 1000, more preferably from about 2 about 500. The molecular weight of the polymer is generally from 1000 to 500,000, preferably from 1000 to 200,000, more preferably from 1,000 to 100,000, most preferably from 2,000-80,000

R1 has a molecular weight generally from 500 to 100,000, preferably from 1500 to 20,000. B has a molecular weight from 100 to 100,000, preferably from 300 to 80,000.

The mole ratio of B:Z is generally from 0.1:1.0 to 4.0:1.0, preferably from 0.3:1.0 to 3.0:1. The mole ratio of R1:13 is from 1:0.25 to 1:5.

The aminoplast ether copolymers can be manufactured as described in U.S. Pat. Nos. 5,914,373 and 5,627,232 to Glancy and U.S. Patent Application Publication No. 2004/010285 to Steinmetz.

A. Additives

The aminoplast copolymers described herein can be administered alone or with one or more additives. The additives can be co-administered with the aminoplast copolymers or can be added prior to, or after, addition of the aminoplast copolymers. The additives can be added at the same point in the pulping and/or papermaking process as the aminoplast copolymers or at different points in the pulping and/or paper making processes.

1. Enzymes

The water soluble aminoplast copolymers described herein can be added to the pulp and papermaking process either alone or in combination with enzymes such as lipases, esterases, and oxidative enzymes. Enzymes have been used to control both pitch and stickies in the pulping and paper making process. Different enzymes such as hydrolases, redoxidases and lysases are known to modify different components in pitch or stickies particles, and therefore provide benefits on pitch and stickies deposition in the pulping and papermaking process. Suitable enzymes include, but are not limited to, hydrolyzing enzymes, such as cellualses, amylases, hemicellulases and pectinases; oxidizing enzymes, such as fatty acid oxidases, glucose oxidases, alcohol oxidases, polyvinyl alcohol oxidases and polyphenol oxidase; esterases, such as lipase and cholesterases; and lyases, such as pectate lyases. Treatment of the stickies and pitch particles with both enzymes and hydrophobically modified aminoplast esters enhance the physiochemical modifications for better control through better removal, dispersion and pacification.

2. Other Additives

The water soluble aminoplast copolymers described herein can be added to the pulp and papermaking process either alone or in combination with other chemical additives, which can be surfactants and/or polymers. Suitable surfactant dispersants include, but are not limited to, primary and branched alkoxylates, fatty acid alkoxylates, phosphate esters and their alkoxylates, alkylphenol alkoxylates, block copolymers of ethylene and propylene oxide, alkanesulfonates, olefinsulfonates, fatty amine alkoxylates, glyceride alkoxylates, glycerol ester alkoxylates, sorbitan ester alkoxylates, polyethylene glycol esters, polyalkylene glycols, polyacrylic acids, sodium polyacrylate, acrylic acid copolymer, acrylate copolymer, acrylic crosslinked copolymer, and their derivatives; maleic acid and acrylic acid or acrylate copolymer, maleic acid/olefin copolymer, and their derivatives; methy cellulose, ethyl cellulose and their derivatives; polyvinyl alcohol/polyvinyl acetate copolymers, polyvinyl pyrrolidone, and their derivatives, cationic polymers, and combinations thereof.

Suitable cationic polymer is selected from the group consisting of, but not limited to, epichlorohydrin/dimethylamine polymers (EPI-DMA) and cross-linked solutions thereof, polydiallyl dimethyl ammonium chloride (DADMAC), polyethylenimine (PEI), hydrophobically modified polyethylenimine, polyamines, resin amines, polyacrylamide, DADMAC/acrylamide copolymers, and ionene polymers.

III. Methods of Treatment

The methods described herein may be used with any pitch-containing pulp. Exemplary pulps include mechanical pulps, such as thermomechanical pulps and groundwood pulps; chemical pulps such as chemo-thermomechanical pulps and kraft pulps; and pulps produced from recycled paper.

The addition point for the polymer can be at any of one or more various locations during in the pulping and paper manufacturing processes. Suitable locations include, but are not limited to, latency chest, reject refiner chest, disk filter or Decker feed or accept, whitewater system, pulp stock storage chests (either low density ("LD"), medium consistency (MC), or high consistency (HC)), blend chest, machine chest, headbox, saveall chest, paper machine whitewater system, and combinations thereof.

The polymer is typically applied as a solution to the pulp stock. Suitable solvents include, but are not limited to, water, copolymers of propylene and ethylene glycol, polypropylene glycol, butyldiglycol, polyethylene glycol and 1,6-Hexanediol. The polymer treatment is effective at a temperature of between about 10° C. to about 95° C., more preferably from about 30° C. to about 75° C. The pH of the pulp stock is from about 3.0 to about 11.0, more preferably from about 4.0 to 7.5. The pH of the stock can be adjusted using a pH modifying agent, such alum or aluminates. The amount of the polymer added depends on several factors such as pH, temperature, presence of other pulp and papermaking additives, and/or the types and amount of pitch and stickies in the pulp. The dosage ranges from 0.005% to 1.0% based on O.D. The consistency of the pulp stock to be treated is typically between about 0.1% and about 35%, more preferably between about 0.5% and about 10%. The pulp can be treated for a period of time from about 0.1 to about 36 hours, more preferably from about 0.5 to about 12 hours.

The aminoplast ether copolymers can effectively reduce the deposition of pitch and stickies on various surfaces in the pulp and paper making processes, which include metal, plastic, and ceramic surfaces such as pipe walls, chest walls, machine wires, felts, foils, uhle boxes, and any equipment surfaces that contact with fibers. Reducing pitch and stickies deposition reduces downstream equipment fouling increasing papermaking efficiency and paper quality.

EXAMPLES

The polymers used in the following examples are summarized in Table 1

TABLE 1

Polymers Used in Examples

| Name | Main components | Company |
|---|---|---|
| Cevol 540 | Polyvinyl alcohol-co-vinyl acetate with 87~89% hydrolysis | Celanese Corporation, Dallas, TX |
| EDT-X1 | Ethoxylated aminoplast copolymer MW: 5,000~15,000 | Enzymatic Deinking Technologies, LLC |
| EDT-X2 | Ethoxylated aminoplast copolymer MW: 35,000~45,000 | Enzymatic Deinking Technologies, LLC |
| EDT-X3 | Ethoxylated aminoplast copolymer MW: 55,000~65,000 | Enzymatic Deinking Technologies, LLC |

Example 1

Deposition Test of Sulfite Pulp and Deinked Pulp Mixture from Mill A

The standard mixing test procedure is used to evaluate the impact of chemicals on deposition tendency on mixing bowls and paddles. A KitchenAid® stand mixer with coated flat paddles, such as the Commercial 5 series from KitchenAid®, was used. The stainless steel mixing bowls were used to hold fiber stocks at consistencies from about 3% to about 20%, preferably from about 8% to 10%. The mixing temperature was controlled with a water jacket at 55° C. The pulp stocks were mixed at speeds between "1" and "4", preferably "2". The stocks were mixed for a period of time ranging from about 5 minutes to about 2 hours, preferably from about 20 minutes to about 1.5 hours.

Representative stock samples consisted of sulfite pulp stock with a consistency of about 12%. 100 g of oven-dried (OD) fiber was used for each test. Hot water (~55° C.) was used to obtain a pulp consistency of about 11% and a desired amount of each chemical was added into the stocks just before mixing. The pH of the pulp stocks was around 8. If the stock pH needed to be adjusted, 1 M HCl and 1 M NaOH solutions were used. The stock was mixed at 55° C. for 45 min after which the mixer paddles were observed and the amount of deposit on paddles and bowls was recorded. The total pitch and stickies deposit on the paddles and mixing bowls was rated visually as a percentage with the non-treated paddle being 100%.

Table 2 shows the relative deposit for sulfite pulp treated with different chemicals. The results indicate that the aminoplast ether compositions, EDT-X1, EDT-X2 and EDT-X3, provided much better reduction on paddle deposition than the polyvinyl alcohol-co-vinyl acetate, a commercially available product used for stickies control. The aminoplast ether copolymers almost completely eliminated pitch deposit on the mixing bowls at the two dosages tested (0.8 lbs/ton and 1.20 lbs/ton), except EDT-X3 at 0.80 lbs/ton which exhibited 10% bowl deposition. However, this was still a substantial reduction compared to Cevol 540.

TABLE 2

Standard Mixing Test Results

| Test Number | Chemicals | Dosage | Relative Paddle Deposition % | Relative Bowl Deposition % |
|---|---|---|---|---|
| 1 | Control | No Chemicals | 100 | 40 |
| 2 | Cevol 540 | 0.80 #/ton | 80 | 35 |
| 3 | Cevol 540 | 1.20 #/ton | 35 | 25 |
| 4 | EDT-X1 | 0.80 #/ton | 75 | 0 |
| 5 | EDT-X1 | 1.20 #/ton | 12 | 0 |
| 6 | EDT-X2 | 0.80 #/ton | 15 | 0 |
| 7 | EDT-X2 | 1.20 #/ton | 4 | 0 |
| 8 | EDT-X3 | 0.80 #/ton | 10 | 10 |
| 9 | EDT-X3 | 1.20 #/ton | 7 | 0 |

Example 2

Deposition Test of Sulfite Pulp from Mill a at Different pH Conditions

The standard mixing test procedure was used in this example. The pH was adjusted using 1 M HCl or 1 M NaOH before the chemical addition. The dosage for all the chemicals was 1.20 lbs/ton. The results are shown in Table 3. The control showed deposit on both paddles from pH4.0 to 8.5. The mixing bowl also showed deposits at about pH 7.9. For Cevol 540, the paddle deposit ranged from 35-80% at all pH values tested, and bowl deposits were around 25% at pH 7.71 and pH 8.57. However, in the presence of EDT-X2 at 1.20 lbs/ton, the paddle deposits were significantly reduced and ranged from 5 to 10% compared to the control paddle. Bowl deposits were completely eliminated at all pH values tested. This further confirmed that the use of aminoplast ether copolymers is more effective in reducing deposition of sulfite organic contaminants compared to polyvinyl alcohol.

TABLE 3

Standard Mixing Test Results at Different pH Conditions

| Test Number | Conditions | pH | Relative Paddle Deposition % | Relative Bowl Deposition % |
|---|---|---|---|---|
| 1 | Control | 4.03 | 63 | 0 |
| 2 | Control | 5.80 | 81 | 0 |
| 3 | Control | 6.58 | 90 | 0 |
| 4 | Control | 7.93 | 100 | 40 |
| 5 | Control | 8.50 | 100 | 5 |
| 6 | Cevol 540 | 4.81 | 5 | 0 |
| 7 | Cevol 540 | 6.67 | 70 | 0 |
| 8 | Cevol 540 | 7.71 | 35 | 25 |
| 9 | Cevol 540 | 8.57 | 85 | 25 |
| 10 | EDT-X2 | 5.09 | 7 | 0 |
| 11 | EDT-X2 | 6.69 | 5 | 0 |
| 12 | EDT-X2 | 7.87 | 7 | 0 |
| 13 | EDT-X2 | 8.47 | 10 | 0 |

Example 3

Deposition Test of 100% Recycled Wastepaper from Tissue Mill B

Mill B uses coated book stock (CBS) and sorted office paper (SOP) wastepaper to produce tissue. Pulp from the washer accept having a consistency of about 12% was collected in the mill. Two pulp batch samples were collected at two different times. The standard mixing test procedure was used in this example with the water jacket temperature maintained at 55° C. and mixing times of 45 mins. 100 g oven dried fibers were used for each mixing test. The amount of stickies deposits on the paddles and mixing bowls for the control were rated visually as 100%, and other testing paddles and bowls were rated comparatively.

TABLE 4

Standard Mixing Test Result for CBS/SOP Stocks

| Test Number | Conditions | Dosage | Relative Paddle Deposition % | Relative Bowl Deposition % |
|---|---|---|---|---|
| 1 | Control | No Chemicals | 100 | 0 |
| 2 | Celvol 540 | 0.80 #/ton | 95 | 0 |
| 3 | EDT-X2 | 0.80 #/ton | 20 | 0 |
| 4 | EDT-X3 | 0.80 #/ton | 30 | 0 |
| 5 | EDT-X1 | 0.80 #/ton | 75 | 0 |
| 6 | Control | No Chemical | 100 | 0 |
| 7 | Cevol 540 | 1.0 #/ton | 45 | 0 |
| 8 | EDT-X2 | 1.0 #/ton | 2 | 0 |
| 9 | EDT-X1 | 1.0 #/ton | 6 | 0 |

Note:
Test Number 1-5 used Pulp Batch 1. Test Number 6-9 used Pulp Batch 2.

As shown in Table 4, the aminoplast ether copolymers showed superior deposition reduction compared to Cevol 540 for both pulp batches at different dosages. For pulp batch 2 at 1.0 lb/ton, EDT-X1 and X2, reduced the paddle deposit to as low as 2~6% compared with 45% paddle deposit with Cevol 540.

Example 4

Deposition Test of MOW Pulp from Mill C

Wastepaper consisting of sorted office pack and sorted white ledger from Mill C was collected for standard mixing tests. The organic contaminants were predominantly stickies. The wastepaper was pulped for 20 min using a batch pulper at pH 7.5 and a consistency of 12%. The whitewater had 400 ppm calcium carbonate hardness. After pulping, the stock was diluted with whitewater to 5% and allowed to soak for 30 minutes. After soaking, the stock was diluted further to 1% with whitewater and thickened to about 12% with a cloth filter bag to remove ash. 100 g oven dried fibers of the 12% prepared stock stated above was used for each mixing test. The bowl with stock was heated to a temperature of 55° C. using a water jacket. Chemical was added to the mixing bowl, and the stock was mixed for 45 minutes. The amount of pitch and stickies deposit on the paddles and mixing bowls for the control were rated visually as 100%, and other testing paddles and bowls were rated comparatively.

TABLE 5

Standard Mixing Test Result for MOW Stocks

| Test Number | Conditions | Dosage | Relative Paddle Deposition % |
|---|---|---|---|
| 1 | Control | No Chemicals | 100 |
| 2 | Cevol 540 | 0.40 #/ton | 75 |
| 3 | EDT-X1 | 0.40 #/ton | 6 |
| 4 | EDT-X2 | 0.40 #/ton | 5 |
| 5 | EDT-X3 | 0.40 #/ton | 23 |
| 6 | Cevol 540 | 0.80 #/ton | 33 |
| 7 | EDT-X1 | 0.80 #/ton | 14 |

TABLE 5-continued

Standard Mixing Test Result for MOW Stocks

| Test Number | Conditions | Dosage | Relative Paddle Deposition % |
|---|---|---|---|
| 8 | EDT-X2 | 0.80 #/ton | 4 |
| 9 | EDT-X3 | 0.80 #/ton | 4 |

As shown in Table 5, the water soluble aminoplast ether copolymers, EDT-X1, EDT-X2 and EDT-X3, showed much higher reduction in paddle deposits than Celvol 540. At 0.40 lbs/ton, Cevol 540 had paddle deposits of 100% and 40%, while most of the EDT-X products had deposit less than 20%. At 0.80 lbs/ton, Cevol 540 had paddle deposits of 45% and 20%. However, most of the EDT-X products had deposits less than 10%. In some tests, the paddle deposits were nearly eliminated.

We claim:

1. A method for controlling pitch and stickies in the pulp and paper making processes and the downstream uses of paper comprising treating pulp stock, mill process water, or combinations thereof, with a composition comprising a water soluble aminoplast ether copolymer having the formula:

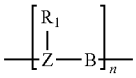

wherein

Z comprises an aminoplast moiety,

B comprises a hydrophobic or a water-insoluble oligomer or polymer, and $R_1$ comprises a hydrophilic oligomer or polymer.

2. The method of claim 1, wherein the aminoplast moiety is the product of the condensation of an aldehyde and one or more amine-containing monomers.

3. The method of claim 2, wherein the one or more aminoplast moieties are selected from the group consisting of

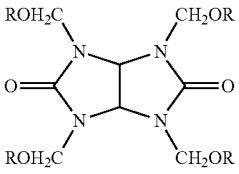

Glycoluril

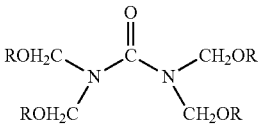

Urea-formaldehyde

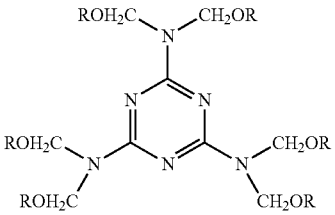

Melamine-formaldehyde

-continued

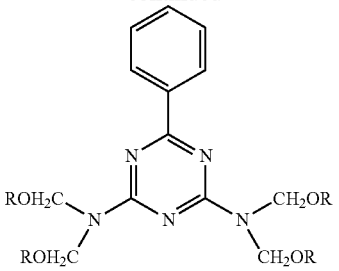

Benzoguanamine where R is an alkyl, alkylene, alkyl ether or alkyl ester group.

4. The method of claim 3, wherein R is a lower alkyl, alkylene, alkyl ether or alkyl ester group with a carbon length of 1 to 4.

5. The method of claim 1, wherein B is selected from the group consisting of poly-n-butyl acrylate, poly-n-butyl methacrylate, polyethyl acrylate, polytetrahydrofuran, polyethyl methacrylate, polymethyl acrylate, polymethyl methacrylate, polymethyl acrylate, polymethyl methacrylate, aliphatic polycarbonates, aromatic polycarbonates, and combinations thereof.

6. The method of claim 1, wherein $R_1$ is selected from the group consisting of methylcellulose, polyacrylic acid, polymethacrylic acid, ethylene/acrylic acid/sodium acrylate copolymer, polyalkylglycol, polyvinyl alcohol, polyvinylpyrrolidone, and combinations thereof.

7. The method of claim 1, wherein n is from about from 1 to about 2000.

8. The method of claim 7, wherein n is from about 1 to about 1000.

9. The method of claim 7, wherein n is from about 2 to about 500.

10. The method of claim 1, wherein the weight average molecular weight of the polymer is from about 1000 to about 1,000,000.

11. The method of claim 10, wherein the weight average molecular weight of the polymer is from about 1,000 to about 500,000.

12. The method of claim 10, wherein the weight average molecular weight of the polymer is from about 1,000 to about 200,000.

13. The method of claim 10, wherein the weight average molecular weight of the polymer is from about 1,000 to about 100,000.

14. The method of claim 10, wherein the weight average molecular weight of the polymer is from about 2,000 to about 80,000.

15. The method of claim 1, wherein the molar ratio of B to Z is from 0.1:1 to 4:1.

16. The method of claim 15, wherein the molar ratio of B to Z is from 0.3 to 1.

17. The method of claim 1, wherein the molar ratio of $R_1$ to B is from about 1:0.25 to about 1:5.

18. The method of claim 1, wherein $R_1$ has a weight average molecular weight from about 500 to about 100,000 g/mol.

19. The method of claim 1, wherein B has a weight average molecular weight from about 100 to about 100,000.

20. The method of claim 1, wherein the copolymer is added to the pulp or paper stock as an aqueous solution.

21. The method of claim 1, wherein the copolymer is added at a location selected from the group consisting of the latency chest, reject refiner chest, disk filter or decker feed or accept, whitewater system; the low density ("LD") chest, the medium density or consistency chest (MC or MD), the high density ("HD") chest, the decker, the blend chest; the machine chest; the headbox, the paper machine ("PM"), the white water system, and combinations thereof.

22. The method of claim 1, wherein the method further comprises contacting the pulp or stock water in the pulp and paper making processes with one or more enzymes.

23. The method of claim 22, wherein one or more enzymes are added simultaneously with the copolymer, prior to the addition of the copolymer, after addition of the copolymer, or combinations thereof.

24. The method of the claim 22, wherein the one or more enzymes are selected from the group consisting of hydrolases, esterases, oxidizing enzymes, lyases, and combinations thereof.

25. The method of claim 24, wherein the hydrolase is selected from the group consisting of cellulases, hemicellulases, amylases and pectinases.

26. The method of claim 24, wherein the esterase is selected from the group consisting of lipases, phospholipases, and cholesterases.

27. The method of claim 24, wherein the oxidizing enzyme is selected from the group consisting of laccases, fatty acid oxidases, glucose oxidases, alcohol oxidases, cholesterol oxidases, polyvinyl alcohol oxidases, polyphenol oxidases, and combinations thereof.

28. The method of claim 24, wherein the lyase is a pectate lyase.

29. The method of claim 1, wherein one or more additives are added simultaneously with the copolymer.

30. The method of claim 29, wherein the additives are selected from the group consisting of primary and branched alkoxylates, fatty acid alkoxylates, phosphate esters and their alkoxylates, alkylphenol alkoxylates, block copolymers of ethylene and propylene oxide, alkanesulfonates, olefinsulfonates, fatty amine alkoxylates, glyceride alkoxylates, glycerol ester alkoxylates, sorbitan ester alkoxylates, polyethylene glycol esters, polyalkylene glycols, polyacrylic acids, sodium polyacrylate, acrylic acid copolymer, acrylate copolymer, acrylic crosslinked copolymer, and their derivatives; maleic acid and acrylic acid or acrylate copolymer, maleic acid/olefin copolymer, and their derivatives; methy cellulose, ethyl cellulose and their derivatives; polyvinyl alcohol/polyvinyl acetate copolymers, polyvinyl pyrrolidone, and their derivatives, cationic polymers, and combinations thereof.

31. The method of claim 30, wherein the cationic polymer is selected from the group consisting of epichlorohydrin/dimethylamine polymers (EPI-DMA) and cross-linked solutions thereof, polydiallyl dimethyl ammonium chloride (DADMAC), polyethylenimine (PEI), hydrophobically modified polyethylenimine, polyamines, resin amines, polyacrylamide, DADMAC/acrylamide copolymers, and ionene polymers.

32. The method of claim 1, wherein the aminoplast ether copolymer is added at a dosage from about 0.005% to 1.0% based on oven-dried fibers.

33. The method of claim 32, wherein aminoplast ether copolymer is added at a dosage from about 0.01% to 0.5% based on oven-dried fibers.

34. The method of claim 1, wherein the pulp is treated with the aminoplast ether copolymer for a period of time ranging from about 0.05 to 24 hours.

35. The method of claim 1, wherein the pulp is treated with the aminoplast ether copolymer for a period of time ranging from about 0.5 to about 12 hours.

36. The method of claim 1, wherein the pulp is produced by a process selected from the group consisting of mechanical pulping, semi-mechanical pulping, bleached Kraft pulping, sulfite pulping, and recovered fiber pulping.

37. The method of claim 36, wherein the pulp is a mechanical pulp selected from the group consisting of groundwood pulp, pressurized groundwood pulp and thermomechanical pulp.

38. The method of claim 1, wherein the pulp or papermaking process involves fibers which are selected from virgin fibers, recycled fibers, and combinations thereof.

39. The method of claim 38, wherein the recycled fibers are selected from the group consisting of old newsprint, mixed office waste, old corrugated containers, and combinations thereof.

40. The method of claim 38, wherein the aminoplast ether copolymer is applied to the fibers at a temperature from about 30° C. to about 95° C.

41. The method of claim 40, wherein the aminoplast ether copolymer is applied to the fibers at a temperature from about 40° C. to 75° C.

42. The method of claim 38, wherein the aminoplast ether copolymer is applied to the fibers at a pH from about 3 to about 11.

43. The method of claim 42, wherein the aminoplast ether copolymer is applied to the fibers at a pH from about 4.0 to about 7.5.

44. The method of claim 1, wherein $R_1$ has a weight average molecular weight from about 1,500 to 20,000.

45. The method of claim 1, wherein B has a weight average molecular weight from about 300 to 80,000.

* * * * *

UNITED STATES PATENT AND TRADEMARK OFFICE

CERTIFICATE OF CORRECTION

PATENT NO. : 8,048,268 B2
APPLICATION NO. : 12/606671
DATED : November 1, 2011
INVENTOR(S) : Chengliang Jiang et al.

It is certified that error appears in the above-identified patent and that said Letters Patent is hereby corrected as shown below:

Claim 40, column 14, line 3, replace "30ºC." with --30ºC--.
Claim 41, column 14, line 6, replace "40ºC." with --40ºC--.

Signed and Sealed this
Thirtieth Day of October, 2012

David J. Kappos

David J. Kappos
*Director of the United States Patent and Trademark Office*